United States Patent [19]

Campbell et al.

[11] 4,141,295

[45] Feb. 27, 1979

[54] ACTUATION MINE SIMULATOR

[75] Inventors: John M. Campbell; Herbert L. Ball; Darrell A. Bymoen, all of Ridgecrest; Douglas G. Ewen; Ronald D. Hise, both of China Lake, all of Calif.; Charles R. Stribley, Scottsdale, Ariz.; Gaylon L. West, Ridgecrest, Calif.

[73] Assignee: The United States of America as represented by the Secretary of the Navy, Washington, D.C.

[21] Appl. No.: 879,286

[22] Filed: Feb. 13, 1978

[51] Int. Cl.[2] ..... F42B 22/04

[52] U.S. Cl. ..... 102/10

[58] Field of Search ..... 102/10

[56] References Cited

U.S. PATENT DOCUMENTS

| | | | |
|---|---|---|---|
| 2,752,615 | 7/1956 | Parker | 102/10 |
| 2,912,929 | 11/1959 | Mattingly et al. | 102/10 |
| 2,947,249 | 8/1960 | Vogt et al. | 102/10 |
| 2,949,853 | 8/1960 | Vogt | 102/10 |
| 3,086,464 | 4/1963 | Butler et al. | 102/10 |
| 3,094,928 | 6/1963 | Costley et al. | 102/10 |
| 3,709,148 | 1/1973 | Costley | 102/10 |

*Primary Examiner*—Charles T. Jordan

*Attorney, Agent, or Firm*—R. S. Sciascia; W. Thom Skeer; Thomas W. Hennen

[57] ABSTRACT

An actuation mine simulator system which enables realistic training experience in mine sweeping operations without the danger accompanying use of live mines. The actuation mine simulator is preprogrammed to respond at predetermined time intervals to actuation by large objects such as ships. The mine simulator includes buoyant flares for signaling actuation, a tethered float having a signal beacon for facilitating recovery, and an underwater acoustic transmitter for locating the simulator at the conclusion of training exercises.

36 Claims, 8 Drawing Figures

ACTUATION MINE SIMULATOR

BACKGROUND OF THE INVENTION

1. Field of the Invention

This invention pertains to sea mine training devices, and more particularly to such devices which respond to the proximate presence of a large object by releasing a visible signal.

2. Description of the Prior Art

Prior mine simulators have utilized a number of service mine components so as to duplicate service mine response to a given target object. Such mine simulators are bulky, including large casings which must be weighted with inert material for negative buoyancy. Since these simulators are often planted from aircraft or from the sides of ships as are real mines, the final mine placement on the sea floor is not exact.

U.S. Pat. No. 3,709,148 issued to Costley et al. discloses a drill mine which has the same operational and physical characteristics as a service mine. The Costley et al. mine is provided with apparatus for indicating mine actuation, and for facilitating retrieval thereof. U.S. Pat. No. 2,949,853 issued to C. C. Vogt discloses another prior mine simulator which releases a tethered float which includes a smoke signal to indicate actuation of the mine simulator. U.S. Pat. No. 3,086,464 issued to F. E. Butler et al. discloses a detachable practice mine section, which, upon activation releases a float, after a predetermined delay, which in turn activates a visible signal indicating actuation of the mine simulator and also the location thereof. U.S. Pat. No. 2,912,929 issued to R. D. Mattingly et al. discloses a submarine drill mine particularly suited for planting in shallow water. When actuated, a surface signal is produced, comprising a charge of chemical which upon reaction with water, forms a gas which in turn spontaneously ignites when exposed to oxygen in the atmosphere at the surface of the water to form a bright flame and large volume of smoke. Each of these U.S. Patents should be studied to gain an appreciation for the scope of the prior art.

SUMMARY OF THE INVENTION

The problems and inconveniences inherent in prior mine simulators have been overcome by the present actuation mine simulator which includes a specially designed water tight housing enclosing instrumentation and a tethered float containing a plurality of separate flare signals. The flares may be launched according to a predetermined sequence to indicate mine actuation. A permanent record is maintained of all ship actuations and may be utilized in post exercise analysis. The mine simulator of the present invention also includes a specially designed search coil, and acoustic transmitter for facilitating location of the simulator after the conclusion of mine exercises, and a beacon attached to a tethered float for facilitating night time simulator location and recovery.

BRIEF DESCRIPTION OF THE DRAWING

Further advantages of the present invention will emerge from a description which follows of the preferred embodiment of an actuation mine simulator according to the invention, given with reference to the accompanying drawing figures, in which.

DESCRIPTION OF THE PREFERRED EMBODIMENT

The actuation mine simulator of the present invention is used in the actuation mine simulator system, and other inventions related thereto, filed with the present invention, include the planting and storage rack and release mechanism, Ser. No. 877,545 filed Feb. 13, 1978, the flare release system, Ser. No. 877,547 filed Feb. 13,1978, and the underwater search coil, Ser. No. 877,546 filed Feb. 13, 1978. Also, U.S. Pat. No. 3,960,087 issued to Beatty et al. teaches a flare which may be used within the actuation mine simulator system.

Figure 1:
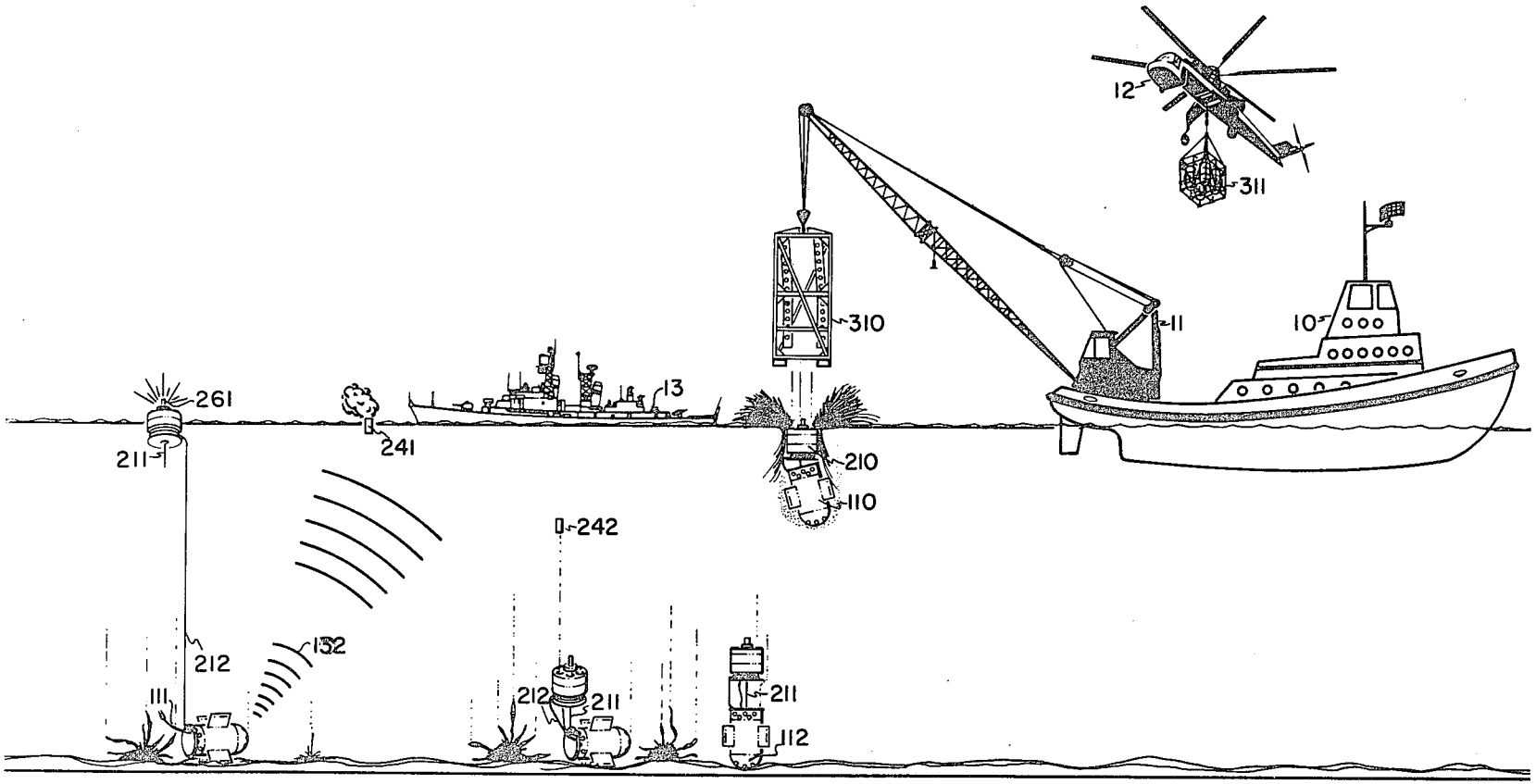
FIG. 1 illustrates the operational environment of the actuation mine simulator, including planting, on station, and recovery phases.

Referring now to the drawings and in particular to FIG. 1, there is shown the operational environment of the actuation mine simulator system. Mine tender 10 having crane 11 is shown supporting mine simulator planting rack 310 above a precise point on the sea floor where placement of a mine simulator is desired. Helicopter 12 is similarly shown transporting a battery of simulator planting racks 311 to a remote location for simulator placement. Simulator 110 is shown moments after release from planting rack 310, and tethered float 210 is shown beginning to separate from simulator 110. Round aluminum nose piece 112 is shown striking the sea floor while float 210 is closely tethered by line 211. Close proximate approach by target ship 13 causes actuation of simulator 110 and release of buoyant flare 242. Flare 241, previously released, has ignited upon approach to the surface and displays a smoke signal.

During the recovery phase, line 211 has been severed permitting float assembly 210 to reach the surface, trailing the recovery line 212. Beacon 261 has been actuated by approach to the surface and conditions of darkness. During float release, instrumentation cable 111 has pulled free of float 210. At the conclusion of mine exercises, mine tender 10 returns and retrieves mine simulator 110 by means of recovery line 212 attached to float assembly 210. The recovered mine 110 is returned to the simulator planting rack 310 for storage and transport to a mine shop for maintenance.

Figure 2:
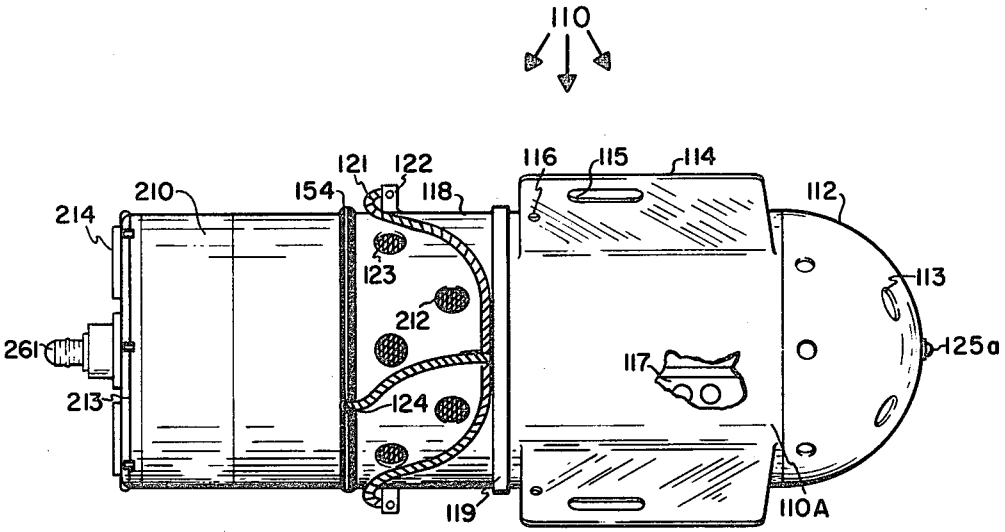
FIG. 2 illustrates a side view partially broken out of an actuation mine simulator according to the invention.

Referring now to FIG. 2 there is shown mine simulator 110 in its assembled configuration. Basic subassemblies of mine simulator 110 include mine case 110A which is water tight to provide housing for instrumentation in instrumentation rack 117, round aluminum nose piece 112 having apertures 113 formed therein, tail plate shroud assembly 118 and float assembly 210. Aluminum nose 112 is attached to mine case 110A by a rod and nut assembly 125A. Aluminum nose 112 insures proper orientation upon contact with sea floor, and serves as a sacrificial cathode for cathodic protection of stainless steel mine simulator 110 exposed to electrolysis in sea water.

Mine case 110A has a plurality of fins 114 attached thereto. Fins 114, preferably 4 in number, serve to orient mine simulator 110 within planting rack 310, help mine simulator 110 scour into a sandy sea floor to help anchor the simulator, and provide means for attachment of recovery lines or planting rack safety pins. Fins 114 have auxiliary handling slots 115 and safety pin holes 116.

Tail plate shroud assembly 118 is attached to mine case 110A by circumferential attachment cinching member 119 in a conventional manner. Tail plate shroud assembly 118 serves to house coiled recovery line 212 which may be seen through apertures 123. Apertures 123 serve to release trapped air to prevent excess buoyancy of simulator 110, the same as do apertures 113 in aluminum nose piece 112. Recovery line 212 passes through a relieved notch 124 in gasekt 154 and attaches to a recovery harness 121 at attach points 122.

Float assembly 210 shown retained to tail plate shroud assembly 118, includes beacon 261, which has a specially designed power circuit to prevent magnetic interference with simulator instrumentation, flare chamber caps 214, and handling line 213.

Figure 3:
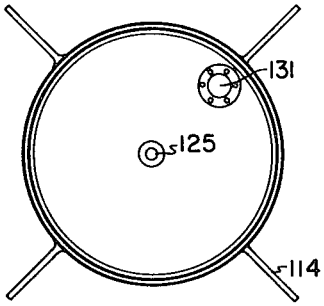
FIG. 3 illustrates an end view of the mine simulator case having the aluminum nose piece removed.

Referring now to FIG. 3 there is shown acoustic transmitter 131 which protrudes a short distance underneath round aluminum nose piece 112. Acoustic transmitter 131 broadcasts a distinctive signal to aid in the location of the mine case after completion of mine exercises. The distinctive signal is audible to either shipboard sonar or diver hand held sonar.

Figure 4:
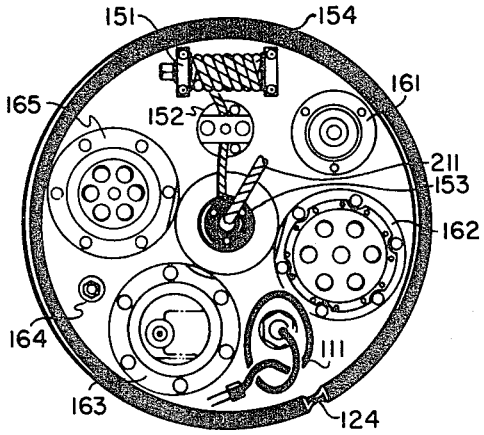
FIG. 4 illustrates an end view of an actuation mine simulator case tail plate shroud with the float assembly removed.

Referring now to FIG. 4 the tail plate shroud assembly is shown including gasket 154, hydrophone 162, hydrostatic switch 161, pressure detector 165, vent plug 164, depth compensator 163, friction retarded reel 151, squib actuated guillotine line cutter 152, and central line guide 153. The functional interrelation of the various components of actuation mine simulator 110 will be explained below.

Figure 5:
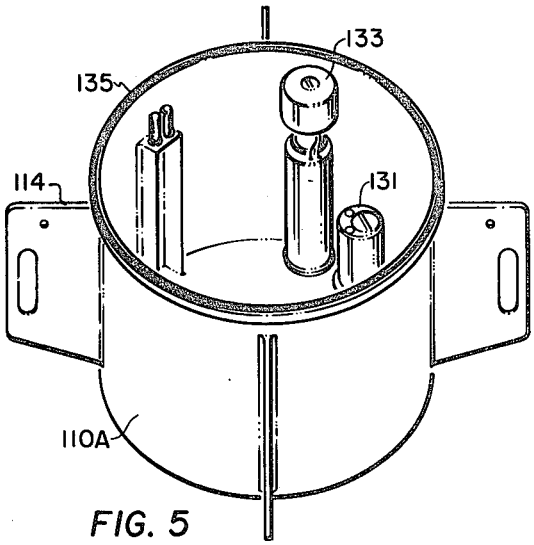
FIG. 5 illustrates a perspective view of the interior of an actuation mine simulator case.

FIG. 5 illustrates in perspective the interior of mine case 110A. Acoustic transmitter 131 and search coil 133 are shown in the installed position. Acoustic transmitter 131 extends through the end of mine case 110A as illustrated in FIG. 3. Also in FIG. 5 is shown O-ring sea 135 which seals against tail plate shroud assembly 118 to provide water tight integrity to the interior of mine case 110A.

Figure 6:
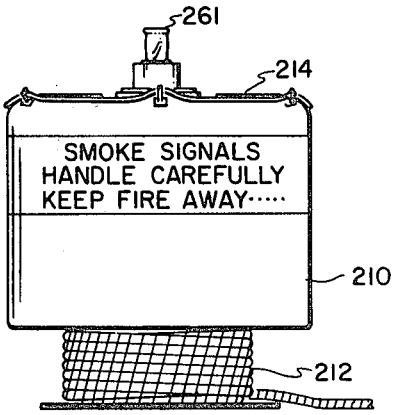
FIG. 6 illustrates a side view of a float assembly.

Referring now to FIG. 6 there is shown a buoyant flare launching platform or housing 210. Housing 210 has a plurality of flare cavities which are sealed from communication with the ambient by detachable cap 214 which has O-ring seal 214A and covering flange 214B. Detachable cap 214 is secured in place by means of a plurality of shear pins 214C having the heads directed toward the center of cap 214, and being retained in place by safety wire **214*D* strung around the outside of flare cavity liner 241'. Shear pins 214C are sized and selected to shear upon application of force from compressed gas in cylinder 225** which may be carbon dioxide, as will be explained below.

Figure 8:
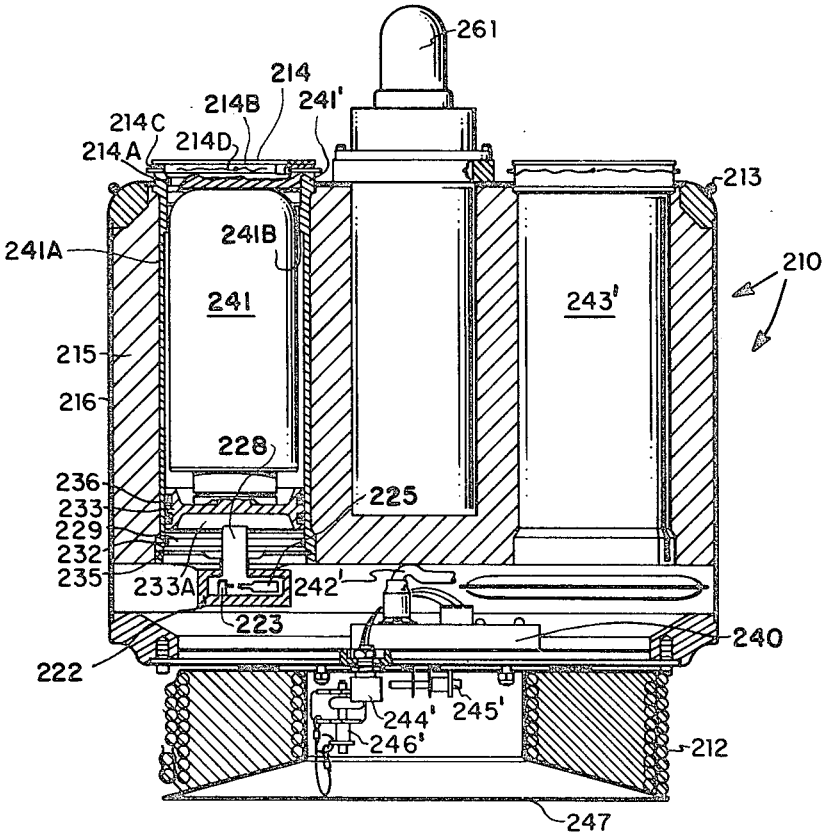
FIG. 8 illustrates a sectional view of a float assembly.

Ejection piston 233, which is sealed against flare cavity liner wall 241A by O-rings 236, is slidable almost the entire length of liner 241', and is retained within liner 241' by shoulder 241B during a flare ejection. Thus, it may be seen that as compressed gas from cylinder 225 passes through aft bulkhead 229, it pressurizes that portion of the flare cavity which is designated 233A in FIG. 8. Pressure in zone 233A causes ejection piston 233 to apply force to flare 241, which transmits force against detachable cap 214, and in doing so causes failure of shear pins 214C, detaching cap 214 and ejecting flare 241 from its cavity. Since flare 241 is buoyant, after it is ejected from buoyant flare launching platform or housing 210, it rises to the surface. Buoyancy of housing 210, partially lost when piston 233 initially causes cap 214 to shear pins 214C and break the seal of O-ring 214A permitting flooding of the flare cavity, is recovered when piston 233 is forced against shoulder 241B near the forward end of cavity liner 241'.

Housing 210 is made buoyant by the inclusion of foam filler 215 or other suitable buoyant material. Outer skin 216 is joined to suitable corner members which may be constructed of aluminum or other common engineering material as is well known in the art to enclose foam material 215 and the plurality of flare launching mechanisms.

Stroboscopic beacon 261 is positioned at the forward end of housing 210 and is powered by batteries stored in the center of housing 210. Beacon 261 is activated by an ambient pressure sensitive switch which enables beacon activation only after housing 210 has reached the surface of the water. Handling line 213 extends around the forward end of housing 210 and is intended to facilitate manipulation of housing 210 by scuba divers or other handling personnel.

The aft end of housing 210 includes electronic circuit 240 for sequentially firing the plurality of flares as will be described below. The flare launching mechanism, illustrated and described in Ser. No. 877,547 filed Feb. 13, 1978 is retained within flare cavity liner 241' by snap ring 235.

The base or aft end of housing 210 includes coiled line 212 which is connected between housing 210 and mine case 110A. Line 212 is attached to housing 210 by a clevis pin at 246'. A second mooring line, not shown, attaches between clevis pin 245' and mine case 110A. Electronic communication between the mine case 110A and electronic circuit 240 is made by an electric cable 111 which attaches a fitting 244' to communicate ship count signals to circuit 240.

Figure 7:
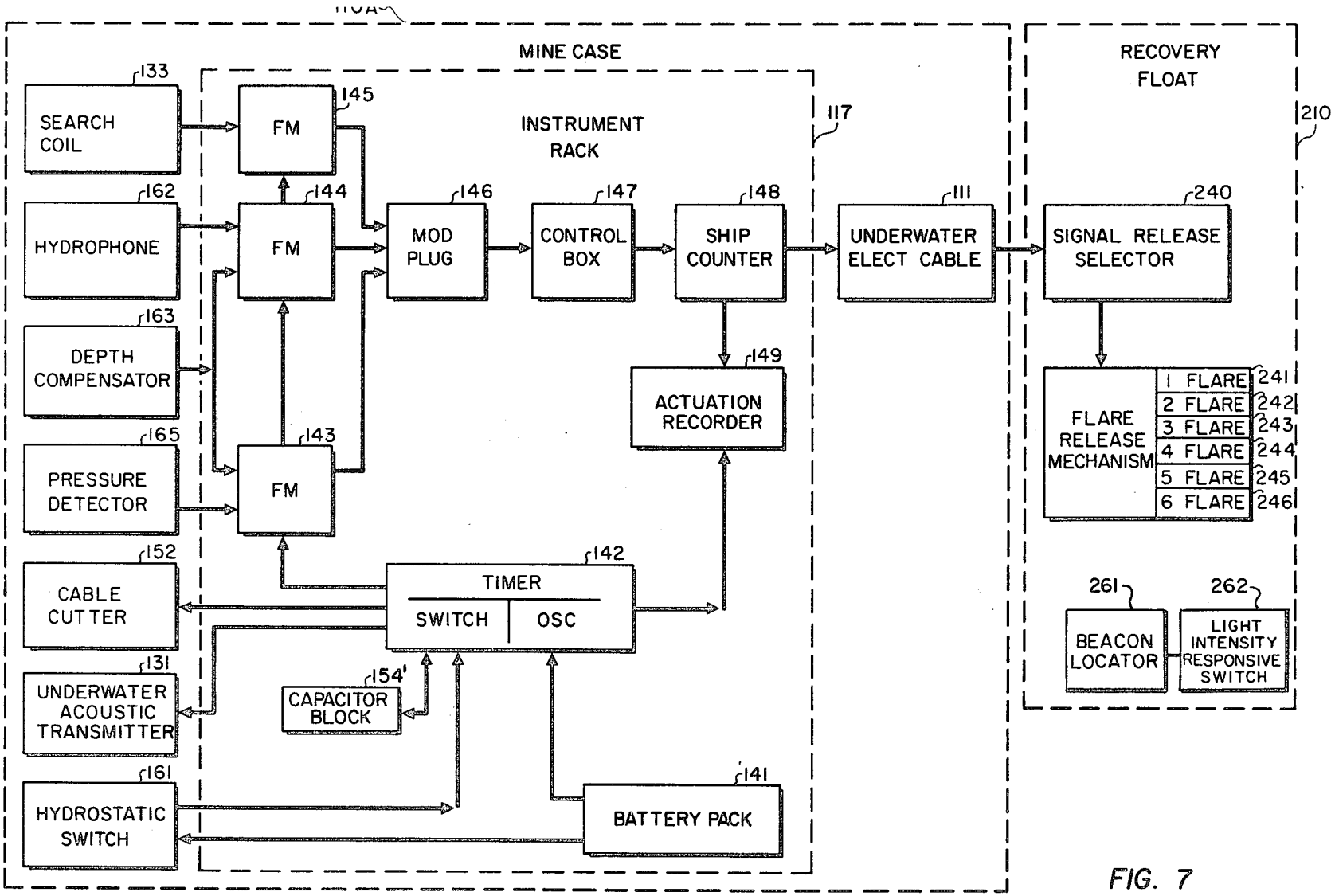
FIG. 7 illustrates the functional relationship between the actuation mine simulator components.

Referring now to FIG. 7 there is shown schematically the functional interrelationships of the various actuation mine simulator components thus far described together with firing modules 143, 144 and 145, module plug 146, control box 147, ship counter 148, actuation recorder 149, timer 142, and battery pack 141. Capacitor block 154' is shown communicating with timer 142. Also, signal release selector 240 is shown communicating with flare release mechanisms for controlling release of flares 241, 242, 243, 244, 245, and 246.

The arrangement of the various components are shown in FIG. 7 by the inclusion within dotted line 110A corresponding to mine case 110A and dotted line 210 corresponding to float assembly 210. Similarly, within dotted line 110A is shown dotted line 117 corresponding to instrument rack 117 which is retained within water tight mine case 110A. Underwater instrument cable 111 is shown communicating with instrument rack 117, attached to mine case 110A and bridging the gap between case 110A and recovery float 210 to communicate with signal release selector 240.

GENERAL OPERATION

The actuation mine simulator of the present invention is capable of being planted by helicopter or surface craft in waters from 30 to 180 feet deep. The submerged time duration of each plant can be preset from 1 to 999 hours. Event recorder 149 contained within mine case 110A provides an accurate and permanent time account of each ship count for post-exercise analysis. Up to 99 ship counts can be recorded. Each simulator 110 will provide up to 6 firing actuations during a single planting. The ship counter 148 returns to its initial setting after each firing actuation. The ship counter functions to simulate a mine detonation after a predetermined number of ships or other bodies have been sensed. This is in accordance with common mine operational procedure.

The simulator is equipped with an underwater acoustic transmitter and a float locater light beacon which are activated for the recovery phase. The acoustic transmitter or pinger is automatically activated in the event of case flooding. The mine case 110A is a non-magnetic stainless steel case housing the mine sensing and control modules, power supply, acoustic transmitter, and actuation recorder. The mine case weighs approximately 360 pounds in air and 155 pounds submerged in sea water. Welded to the case are 4 external fins to promote bottom stability and ease of mine handling. A nose piece is attached to the forward bulkhead and a tailplate shroud assembly forms the aft end of the mine case all as previously described. In addition to previously described functions of nose piece 112, it also serves to cushion the shock of water impact when the simulator is air dropped from a helicopter. As previously described it provides cathodic corrosion protection for adjoining stainless steel mine case 110A and tail plate shroud assembly. Finally, it insures proper bottom orientation for the magnetic search coil by preventing the mine from settling in a nose down attitude.

The tail plate/shroud assembly is attached to the aft end of the mine case and provides an interface between the mine case and float assembly, a protected mounting surface for the hydrostatic pressure switch 161, pressure detector 165, depth compensator 163, and hydrophone 162, contains the underwater electrical cable 111 which carries power and the firing signal to the float, and contains the float tether line anchor provision including a guide 153, a drag device 151 to reduce tether line shock loads during planting, and a cable cutting device 152 to sever the tether line at recovery time.

Contained within the mine case is an instrument rack assembly consisting of a closed rack or frame 117 in which are located mine component modules and the power supply. Some of the instrument rack components are derived from existing service mines. The timer is a low power, solid state timing device having a self contained clock and switches to control the arming delay and recovery time. The actuation counter 148 is a low power, solid state counting device that allows a predetermined number of ship counts to register before completing the firing circuit. The counter also provides a preset intership dead period during which a ship count cannot be registered. Actuation recorder 149 is a low power, solid state digital recorder having a self contained clock and tape printout. The recorder provides a permanent record of each ship count by event number and time of occurrence.

The float assembly, FIG. 6, is a cylindrical shaped aluminum shell measuring approximately 15 inches high and 18 inches in diameter. In the loaded condition it weighs 100 pounds in air and has a 35 pound buoyancy when submerged in sea water. The float assembly 210 contains 6 flare compartments with associated flare release mechanisms, and a solid state fire signal sequencing device 240. Internal cavities of the float are filled with a closed cell polyurethane foam for additional structural rigidity and to secure adequate buoyancy in the event of float leakage. When a firing signal pulse is received from the actuation counter 148, the sequencer 240 directs it to the next signal flare to be ejected according to a predetermined sequence.

The flare release mechanism consists of a squib 222, a firing pin or spiked piston 223, an 8 gram $CO_2$ cartridge or compressed gas cylinder 225, and a pneumatically driven flare ejection piston. The cold $CO_2$ gas system provides a relatively slow ejection rate with high initial force to ensure flare release at maximum operating depth. Maximum height of a flare ejection in air is less than 24 inches. After the flare has been ejected, the piston remains seated at the top of a carbon dioxide ($CO_2$) filled release cylinder, maintaining float buoyancy and protecting the cylinder walls from sea water exposure.

The beacon locator 261 is a self contained, high intensity, flashing lamp. It is activated by reduced hydrostatic pressure as the float rises to the surface during recovery. A light sensor 262 on the beacon turns the unit off during daylight to conserve batteries. Operating life of the beacon is approximately 100 hours. when used intermittently.

Recovery line 212 is secured to the bottom cover plate of float assembly 210 and is a 220 foot reel of $\frac{3}{8}$ inch nylon recovery line that remains attached to the submerged mine case. The recovery line has an ultimate strength of approximately 3,900 pounds and is used for hoisting the submerged mine to the surface and aboard the recovery mine tender 10. The planting rack assembly 310 is an open sided, box frame structure of aluminum angle designed to enclose and support the mine simulator in a vertical nose down attitude while in storage, when being transported, and during planting operations. Rack weight is 125 pounds empty and 580 pounds with the mine simulator enclosed. An integral lifting eye and open base facilitate handling the rack by fork lift or by sling suspension from an overhead crane. Four racks can be clustered for palletized handling and storage and for more efficient helicopter planting operations. The mine simulator is held in position by the fins that fit into two spaced channel guides located in opposite corners of the rack. Spring locking latches prevent the fins from passing through the guide. A clevis or safety pin, secured through a channel guide and fin, locks the mine simulator in the rack for handling and storage. During the planting operation the latches are electrically released, allowing the mine simulator to pass through the rack and free fall nose first into the water. A release control box and electrical extension cable allow the mine simulator to be released by an operator in a helicopter 12 or on board the surface craft 10.

The actuation recorder 149 is a low power, solid state digital recorder that prints out, in numeric format on tape, a permanent record of each ship count received from the actuation counter 148. The ship count pulse is recorded by event number and the time of occurrence is noted in days, hours, and minutes for post exercise analysis. The event recorder digital clock is adjusted to current real time during mine assembly. The recording tape is a 12 foot length of $\frac{1}{4}$ inch electro-sensitive paper contained in a small metal cassette. The cassette is removable to allow retrieval of the recorded data and for reloading of fresh tape.

The actuation counter 148 is a low power, solid state actuation counter that electronically registers a preset number of ship count pulses and then completes the mine firing circuit after this number of ships have been counted. The actuation counter then electronically resets itself to the initial ship count setting and commences a new series of ship counts. A dead period is generated after each ship count during which the actuation counter is prevented from accepting any additional ship count pulses for a predetermined period of time.

The timer 142 is a low power, solid state timing device having a crystal control oscillator. The timer has an accuracy of + or − 0.01 percent and controls the preset arming delay and recovery time periods. The timer oscillator frequency provides the time base for the actuation recorder 149. The timer may be adjusted to set the number of hours before arming will occur after the device is planted, and the number of hours after planting when the recovery phase will begin. Upon completion of the time to arm after planting, the timer turns on switches applying power to the mine sensing and actuation circuits. Upon completion of the plant duration, the timer turns off circuits to remove power and to initiate the recovery process. During recovery the timer actuates the tether line cable cutter 152 to release the float 210 to the surface, and turns on the underwater acoustic transmitter 131 to aid in locating the submerged mine simulator.

The underwater search coil 133 is a miniaturized 15 inch long version of the five foot service mine search coil. To compensate for the miniature size of the search coil, an integral DC amplifier with self contained power supply is used. The amplifier is equipped with a suppressor circuit to prevent spurious looks from nearby electronic components in the instrument rack during the reset function.

The underwater acoustic transmitter is a selfcontained acoustic pinger located on the mine case forward bulkhead. The pinger is automatically activated at mine recovery time, or in the event of mine case flooding, to assist recovery personnel in locating the submerged mine simulator. A self contained timer also allows the pinger to self energize upon completion of a 7, 15, 30, or 45 day delay period commencing at mine assembly. Once activated, the operating life of the pinger is in excess of 6 weeks. A light emitting diode mounted on the aft end of the pinger indicates pinger operation.

Capacitor block 154' consists of two electrolitic capacitors wired in parallel and embedded in a foam block. When charged, these capacitors furnish the firing energy for igniting the squib within guillotine line cutter 152. Actuation of the squib within line cutter 152 causes line cutter 152 to sever line 211 and release float 210 during the recovery phase.

The signal release selector 240 is a solid state stepping device containing 6 squib firing circuits. The sequencer processes the ship count fire signal pulses from the actuation counter 148 to step the selector and trigger, in turn, each squib firing circuit in successive order, 1 at a time.

The signal flares 241–246 used in float 210 may be yellow, or green, or other colors and are cylindrical in shape, approximatly 4 inches in diameter by 9.5 inches long and weight approximately 2.67 pounds each in air. They produce a colored smoke for 70 + or − 20 seconds followed by a flame of the same color as the smoke for an additional 25 + or − 10 seconds. The flare is armed during ejection from the float and ignited by exposure of an enclosed sea water battery as the flare approaches the surface. The flares as previously described may be constructed according to the teachings of U.S. Pat. No. 3,960,087.

Loading the signal flares into the flare well ejection cylinders is accomplished as follows:

Looking down into the flare well cylinder from above the float, insure that the ejection pistons are bottomed in the cylinder and that the walls are lined with a thin coating of grease.

Unscrew the flare plastic arming button protective cap, and with thumb inserted in arming button hole, apply lateral pressure to sealing disc stem until seal is broken. This relieves any vacuum or pressure that may exist in the battery cavity, and enables the sealing disc to remain closed until just before the flare surfaces. This limits flare action to the surface for maximum visibility.

Insert the flares, base down, into each cylinder. The hole in the flare arming button must seat on the piston alignment boss.

Install O-ring seals on flare well caps, and insert caps in the cylinder on top of the flare. Force lid cap down against arming button spring pressure and secure with shear pins. Safety wire the shear pins where they extend out of the flare well shoulders.

Unloading unexpended signal flares is accomplished as follows:

Insure that no water is present that could activate an inadvertantly exposed seawater battery.

Remove safety wire and shear pins.

Remove flare well caps by prying off with finger tips.

Flare may be grasped by fingers, but it may be necessary to tilt the float upside down to remove flares. Inspect arming button to make sure detent pins are in locked or safe position.

Replace the plastic arming button protective caps and remove flares to pyrotechnic storage area for later use.

Locator beacon 261 is a high intensity, xenon gas discharge, flashing strobe light mounted in a well on the top center position of the recovery float. The beacon is light weight, non-magnetic and self contained. It is powered by a 12 volt battery pack and a solid state DC/DC inverter. The beacon is activated by reduced hydrostatic pressure as the float rises to the surface during recovery. The beacon will operate for a minimum of 5 days continuously. A photo electric cell is incorporated in the beacon circuit to extinguish the flashing light during daylight hours to conserve battery power.

Flare ejection is powered by a $CO_2$ cartridge or compressed gas cylinder 225 incorporated within a manifold cap assembly attached to float 210 at each flare cavity. The manifold cap assembly consists of an end cap 229 for the bottom of the flare well cylinder to which is attached a gas manifold system 221 containing $CO_2$ or other gas cylinder 225 and squib or squib actuator 222. The cap provides a gas tight pressure seal and is secured in place by means of retaining ring 235. Upon receipt of an electrical firing pulse, squib actuator 222 causes spiked piston or firing pin 223 to perforate $CO_2$ or other compressed gas cylinder diaphragm. The released $CO_2$ or other gas is directed by the manifold system 221, through passage 228 and the end cap 229 to the bottom of the flare ejection piston 233, forcing it up the flare cylinder and ejecting the signal flare.

SYSTEM OPERATION

Mine simulator 110 is normally retained in a planting rack for protection and ease of handling while in storage, when being transported, and during planting operations. For long term storage the mine simulator is made inert by removing the instruments, sensors, batteries, squib actuators, $CO_2$ cartridges, and pyrotechnic signal flares. A planting rack containing a mine simulator may be readily picked up and moved with either a fork lift or an overhead crane. During assembly the following actions should be taken:

The instrument rack with components corresponding with the service mine being simulated is installed. The arming delay and recovery time periods, each ranging between 1 and 999 hours, are preset in the timing module 142. The ship counter 148 is set for the desired number of counts per firing and the desired intership dead period. The event recorder digital clock is adjusted to current real time.

Loading or removing the mine simulator from the planting rack is accomplished by using the rack strongback with a suspension sling from an overhead crane. Lugs welded to the sides of the tail plate/shroud assembly provide lifting points for the assembled mine simulator and float. Holes in the mine fin plates provide lifting points for the unassembled mine case. A rope railing secured around the top of the float provides both the lifting points for handling the float and hoisting the float from the water during recovery operations.

During mine simulator assembly, the inert mine simulator is removed from the release rack and is placed on an assembly jig where the instrument rack assembly and sensors corresponding to the simulated service mine are installed. The signal flares, squib actuators, and $CO_2$ cartridges are installed in the float assembly. The crystal controlled oscillator circuit for the timing module and event recorder is energized, and the event recorder is adjusted to current real time. Upon completion of mine assembly the mine simulator is placed in the release rack or planting rack and secured awaiting pickup, delivery, and planting operation.

At the planting site the release rack with enclosed mine simulator is placed in a cleared, open area and picked up by a hovering helicopter trailing an 18 foot nylon pendant from its cargo hook. Ground handling personnel engage the pendant swivel hook in the rack strongback lifting eye. After planting, the empty rack is returned to the cleared area, disengaged from the helicopter and stored, pending later recovery of the mine simulator. When using helicopter delivery, care should be taken to discharge any static electrical charge accumulated on the helicopter, pendant, or rack for personnel safety. Helicopter mine simulator releasing limitations are 0 to 50 feet altitude and 0 to 15 knots ground speed with optimum conditions at 30 feet altitude and 10 knots ground speed. A second method of delivering the mine simulator is by surface craft where the rack with enclosed actuation mine simulator is picked up and suspended over the side from the ship cargo handling boom.

In both methods of delivery, the mine simulator electrical release actuator circuit is connected to a remote control box through a quick disconnect fitting located near the pendant hook. The electrical connection is made at the same time the pendant hook is engaged in the rack lifting eye. The remote control box consists of a small, hand held box containing batteries, electrical switches, indicator lights, and an electrical extension cord. The control box allows the operator to check continuity of the mine releasing circuit and to electrically power the linear actuator release mechanism. The extension cord from the control box to the rack releasing device has a quick disconnect fitting to facilitate electrical hook up at the same time the rack is picked up for planting operations.

Immediately after the rack and mine assembly has been picked up by the helicopter or boom for transporting to the planting site, the control box is connected to the rack releasing mechanism and a continuity check is made on all of the linear actuator circuits to insure that connections are intact before leaving the pickup area. Electrical continuity checks are again made at the planting site to verify that connectors have not become separated enroute.

Upon impact with the water, float buoyancy causes the float to separate from the mine case as the mine simulator submerges. However, the float remains attached to the mine case by a short 3 foot tether line. An underwater electrical firing cable and recovery line also remain attached between the float and the mine case. Hydrostatic pressure switch 161 energizes the timing module clock at an 18 foot depth to start the delay arm and recovery time period. As the mine settles into a horizontal position on the bottom surface, the float remains moored approximately 3 feet above it.

After completion of arming delay period and upon receipt of the proper type, sequence, and number of sensor looks, a signal is sent to the actuation counter 148, causing it to step down 1 number from its present ship count setting. This process is repeated, stepping down 1 additional number each time until the actuation counter reaches 0 at which time a firing signal is passed to the float, allowing one signal flare to be ejected. The actuation counter then automatically returns to its initial setting. The signal flare is armed during ejection and ignited when it reaches the surface. The ignited flare produces a heavy colored smoke for a short period of time followed by a flame of the same color for an additional short period of time.

Upon completion of the recovery time period set in the timing module 142, a squib powered cable cutter or line cutter 152 is actuated to sever the float tether line 211. The float rises to the surface paying out a self-contained recovery line 212 attached to the submerged mine case 110A at the tail plate/shroud assembly 118. As the float rises, the underwater electrical firing cable connector 111 is pulled free from its receptacle in the float bottom cover plate.

Mine simulator recovery is conducted by surface craft only. To facilitate visual acquistion of the surface float, it is painted bright orange and white. Under adverse lighting conditions, a flashing marker beacon 261 is activated as the float reaches the surface. A back up system consisting of an acoustic pinger located in the submerged mine case 110A is also activated to aid in determining mine position if the float should fail to surface. The surfaced float, which weighs approximatly 85 pounds with flares expended, is retrieved manually, and the attached recovery line removed. The float is then lifted manually or hoisted aboard the recovery ship. The recovery line slack is removed by pulling on the recovery line until the recovery ship is directly over the submerged mine. The recovery line is then used to hoist the submerged mine aboard the recovery ship or mine tender 10. The recovered simulator is then washed down with fresh water and replaced with its float in an empty planting rack for protective storage and handling. The present mine simulator may be made to simulate a wide variety of service mines merely by including components from those mines within instrumentation rack 117 so as to duplicate the interior mechanisms.

The foregoing description taken together with the appended claims constitute a disclosure such as to enable one skilled in the mine laying arts and having the benefit of the teachings containd therein to make and use the invention. Further, the structure and methods described therein may be seen to constitute an advance in the art which is unobvious to an artisan not having the benefit of such teachings.

Obviously many modifications and variations of the present invention are possible in light of the above teachings. It is therefore to be understood that within the scope of the appended claims the invention may be practiced other than as specifically described.

What is claimed is:

1. A mine simulator, comprising:

a housing defining a water-tight compartment;

a float having a plurality of signaling devices;

a tetherline having two ends and a first predetermined finite length, said line being attached on one end to said housing and attached on the other end to said float;

detecting means within said compartment for producing a ship count signal in response to the proximate passage of a body;

processing means within said compartment and communicating with said detecting means for producing a signaling device launch signal in response to a predetermined number of said ship count signals;

recording means within said compartment and communicating with said processing means for making a permanent record of said ship count signals; and sequencing means within said float communicating with said processing means and with said signaling devices for selectively activating said signaling devices in response to said launch signals.

2. A mine simulator as set forth in claim 1, further comprising:

a timer within said compartment having means for generating a termination command in response to predetermined conditions; and an acoustic transmitter within said compartment, communicating with said timer, and configured to broadcast an acoustic signal in response to said termination command.

3. A mine simulator as set forth in claim 1, further comprising:

a timer within said compartment having means for generating a termination command at a preselected time; and line parting means attached to said housing and engaging said tetherline for cutting said tetherline in response to said termination command.

4. A mine simulator as set forth in claim 1, further comprising:

an electrical switch attached to said float, operative to control flow of electric current, and responsive to light intensity in the float environment; and an electric beacon attached to said float and powered by electric current controlled by said switch.

5. A mine simulator as set forth in claim 1, further comprising:

a recovery line having two ends and a second predetermined finite length, said recovery line being attached on one end to said float, and on the other end to said housing;

said second predetermined finite length being greater than said first predetermined finite length.

6. A mine simulator as set forth in claim 1 wherein said float has a plurality of launching devices, one for each signaling device, each launching device comprising:

said float defining a first volume configured to contain a signaling device, and having two ends and a cylindrical wall;

a detachable cover sealingly attached to said float and abutting one end of said first volume;

an ejector piston having first and second sides, sealingly engaging said cylindrical wall and slidable between first and second positions, said first side of said ejector piston abutting said other end of said first volume;

a container for high pressure gas, having a frangible seal;

high pressure gas within said container;

manifold means, including said second side of said ejector piston, for confining said high pressure gas and enclosing said container, and firing pin means communicating with said sequencing means for rupturing said frangible seal in response to selective activation of a signaling device by said sequencing means.

7. A mine simulator as set forth in claim 1, further comprising:

pressure sensitive means connected to said processing means for producing a ship count signal in response to a change in ambient pressure.

8. A mine simulator as set forth in claim 1, further comprising:

sound detection means connected to said processing means for producing a ship count signal in response to acoustic energy.

9. A mine simulator as set forth in claim 1 wherein said detecting means comprises a passive search coil.

10. A mine simulator as set forth in claim 1 wherein said housing comprises stainless steel.

11. A mine simulator as set forth in claim 1, wherein said housing has a plurality of external fins.

12. A mine simulator as set forth in claim 1, further comprising an apertured hemispherical aluminum nose piece.

13. A mine simulator as set forth in claim 1, further comprising a sacrifical metallic cathode electrically connected to the exterior of said housing.

14. A mine simulator as set forth in claim 1, wherein said float encloses six separate signaling devices.

15. A mine simulator as set forth in claim 1, wherein said signaling devices are buoyant smoke flares.

16. A mine simulator as set forth in claim 1 in combination with a planting rack.

17. A mine simulator as set forth in claim 1, wherein said housing includes frictional means for paying out said tetherline in response to tension in said tetherline caused by buoyant forces acting on said float.

18. A mine simulator as set forth in claim 1, wherein said recording means comprises a digital recorder and a length of electrosensitive paper tape.

19. A mine simulator as set forth in claim 1 wherein said recording means is configured to record ship count pulses by event number and time of occurence.

20. A mine simulator as set forth in claim 1 wherein said sequencing means comprises a solid-state stepping device.

21. A mine simulator as set forth in claim 2 wherein said timer generates a termination command in response to said housing compartment becoming flooded.

22. A mine simulator as set forth in claim 2, wherein said timer generates a termination command at a preselected time after planting.

23. A mine simulator as set forth in claim 3, wherein said line parting means comprises an electrically initiated squib powered guillotine line cutter.

24. A mine simulator as set forth in claim 5 wherein said float has drum means for accepting and releasably retaining said recovery line in a coiled configuration.

25. A mine simulator as set forth in claim 6, wherein said float has six launching devices.

26. A mine simulator as set forth in claim 6, wherein said high pressure gas comprises carbon dioxide.

27. A mine simulator as set forth in claim 6 wherein said firing pin means comprises an electrically initiated squib and a spiked piston configured to be propelled by said squib.

28. A mine simulator as set forth in claim 8 wherein said sound detection means comprises a hydrophone.

29. A mine simulator, comprising:

a stainless steel case defining a housing open on one end and having a plurality of external fins;

a tailplate/shroud sealingly attached to said case open end defining a water tight compartment within said case;

a float having a plurality of separate signaling devices;

a tetherline attached on one end to said case, and attached on the other end to said float;

a recovery line attached on one end to said case and attached on the other end to said float;

instrumentation means contained within said compartment and communicating with said float for activating said signaling devices, one at a time, in response to environmental disturbances; and an aluminum hemispherical nose piece attached to said case opposite said tailplate/shroud.

30. A mine simulator as set forth in claim 29 wherein said aluminum hemispherical nose piece is electrically connected to said stainless steel case and serves as a sacrificial cathode.

31. A mine simulator as set forth in claim 29, wherein said float has piston means for pneumatically expelling said signaling devices, one at a time.

32. A mine simulator as set forth in claim 29, wherein said signaling devices are buoyant smoke flares.

33. A mine simulator as set forth in claim 29, in combination with a planting rack.

34. A mine simulator as set forth in claim 29, wherein said instrumentation means includes detecting means for sensing environmental disturbances, firing module means for generating a ship count signal in response to an environmental disturbance, counting means for transmitting a signalling device launch signal in response to a predetermined number of ship count signals, recording means for recording each ship count, and sequencing means for launching each of said signaling devices, one at a time, in a predetermined order.

35. A mine simulator as set forth in claim 34 wherein said instrumentation means further comprises a timer for activating said detecting means during a predetermined time period.

36. A mine simulator as set forth in claim 35 further comprising a hydrostatic switch attached to said mine simulator and operative to control flow of electric power to said timer in response to predetermined ambient pressure.

* * * * *